US009724655B2

(12) United States Patent
Yoon et al.

(10) Patent No.: US 9,724,655 B2
(45) Date of Patent: Aug. 8, 2017

(54) CONTAINER FOR STIRRER

(71) Applicant: LG Chem, Ltd., Seoul (KR)

(72) Inventors: Du Seong Yoon, Daejeon (KR); Song Taek Oh, Daejeon (KR); Ji Hee Ahn, Daejeon (KR)

(73) Assignee: LG Chem, Ltd. (KR)

( * ) Notice: Subject to any disclaimer, the term of this patent is extended or adjusted under 35 U.S.C. 154(b) by 0 days.

(21) Appl. No.: 14/291,690

(22) Filed: May 30, 2014

(65) Prior Publication Data

US 2014/0284408 A1 Sep. 25, 2014

Related U.S. Application Data

(63) Continuation of application No. PCT/KR2014/000465, filed on Jan. 16, 2014.

(30) Foreign Application Priority Data

Mar. 21, 2013 (KR) ..... 10-2013-0030345

(51) Int. Cl.
*B01F 9/00* (2006.01)
*B01F 7/04* (2006.01)
(Continued)

(52) U.S. Cl.
CPC ..... *B01F 7/04* (2013.01); *B01F 9/0001* (2013.01); *B02C 17/08* (2013.01); *B02C 17/18* (2013.01);
(Continued)

(58) Field of Classification Search
CPC ..... B02C 17/16; B02C 17/163; B02C 17/14; B02C 18/12; B02C 18/20; B02C 17/18;
(Continued)

(56) References Cited

U.S. PATENT DOCUMENTS 192,684 A * 7/1877 Dexter, Jr. ..... A47J 43/044 261/32
2,416,746 A * 3/1947 Gavin ..... 241/30
(Continued)

FOREIGN PATENT DOCUMENTS

CN 202169148 U 3/2012
CN 202410574 U 9/2012
(Continued)

OTHER PUBLICATIONS

International Search Report for Application No. PCT/KR2014/000465 dated Apr. 21, 2014.

*Primary Examiner* — David Bryant
*Assistant Examiner* — Lawrence Averick
(74) *Attorney, Agent, or Firm* — Lerner, David, Littenberg, Krumholz & Mentlik, LLP

(57) ABSTRACT

The present invention relates to a container for a stirrer used in a stirrer stirring objects through a centrifugal force. The container for the stirrer includes a container body of which the top is opened and in which a receiving space is formed, an outer lid coupled to the top of the container body, and a crushing unit including a supporting member disposed in the receiving space, and a crushing member extending outward from the supporting member and crushing and stirring the objects received in the receiving space. Thus, nanoparticle-sized objects can be rapidly crushed and stirred without agglomeration.

6 Claims, 3 Drawing Sheets

(51) Int. Cl.
*B02C 17/08* (2006.01)
*B02C 17/18* (2006.01)

(52) U.S. Cl.
CPC .... *B02C 17/182* (2013.01); *B01F 2009/0092* (2013.01)

(58) Field of Classification Search
CPC ..... B02C 17/182; B02C 17/08; A47J 43/043; A47J 43/07; A47J 43/0722; A47J 43/044; A47J 43/04; A47J 43/0705; B01F 7/04; B01F 9/0001; B01F 2009/0092; B65D 45/02; B65D 51/24
USPC ..... 241/172, 199.12, 282.1, 282.2; 99/509, 99/510, 511, 513; 220/328, 327, 212; 206/219–222
See application file for complete search history.

(56) References Cited

U.S. PATENT DOCUMENTS 3,015,451 A * 1/1962 Goeser ..... 241/172
3,024,010 A * 3/1962 Sperling ..... 366/314
3,124,314 A * 3/1964 Klein ..... 241/172
3,527,416 A * 9/1970 Detjen ..... 241/60
3,877,650 A * 4/1975 Cornford ..... 241/71
4,206,879 A * 6/1980 Geiger ..... 241/46.11
5,314,125 A * 5/1994 Ohno ..... 241/175
5,570,848 A * 11/1996 Gock et al. ..... 241/172
5,660,340 A * 8/1997 Baughman ..... 241/74
5,882,246 A * 3/1999 Inkyo ..... B02C 17/161 241/171
6,071,006 A * 6/2000 Hochstein ..... A47J 43/042 366/242
6,367,963 B2 * 4/2002 Sanpei ..... A47J 43/04 366/208
6,595,680 B2 * 7/2003 Sanpei ..... A47J 43/08 366/147
6,604,455 B2 * 8/2003 Areh et al. ..... 99/510
7,011,260 B2 * 3/2006 Ozawa ..... 241/57
7,047,875 B1 * 5/2006 Eastman, III ..... A22C 9/005 366/139
8,028,944 B2 * 10/2011 Firestone ..... B01F 7/00458 241/172
8,469,586 B2 * 6/2013 Schleinzer ..... A47J 43/044 366/202
8,500,053 B2 * 8/2013 Chan et al. ..... 241/282.1
8,906,586 B2 * 12/2014 Mitsumori et al. ..... 430/56
2002/0172091 A1 11/2002 Hatakeyama
2005/0193896 A1 * 9/2005 McGill ..... A47J 39/006 99/348
2009/0084874 A1 4/2009 Alam et al.
2013/0264405 A1 * 10/2013 Audette ..... 241/277

FOREIGN PATENT DOCUMENTS

CN 202478847 U 10/2012
JP H06-64719 U 9/1994
JP 2002291768 A 10/2002
JP 2002336138 A 11/2002
JP 2005040745 A 2/2005
JP 2006192385 A 7/2006
JP 2006212489 A 8/2006
JP 2011218309 A 11/2011

* cited by examiner

CONTAINER FOR STIRRER

CROSS-REFERENCE TO RELATED APPLICATIONS

The present application is a continuation of International Application No. PCT/KR2014/000465 filed on Jan. 16, 2014, which claims the benefit of Korean Patent Application No. 10-2013-0030345, filed on Mar. 21, 2013, the disclosures of which are incorporated herein by reference.

TECHNICAL FIELD

The present invention relates to a container used in a revolving and rotating stirrer, and more specifically to a container for a stirrer in which a structure of the container is improved to simultaneously crush and disperse nanoparticle-sized objects, thereby enhancing a mixing force.

BACKGROUND ART

Generally, a revolving and rotating stirrer is an apparatus for stirring materials in a container using only a centrifugal force, and such a revolving and rotating stirrer revolves and rotates a container which is opened and closed by a lid to allow objects received in the container to be mixed.

A detailed description for this type of stirrers is disclosed in Japanese Patent Application Laid Open Publication No. 2005-40745.

However, if particle sizes of the objects are a few tens of nanometers, the aforementioned revolving and rotating stirrer has a problem in that the dispersion of the objects could not be achieved well using only the centrifugal force because the objects tend to agglomerate together.

To resolve this problem, a planetary mixer which mixes objects having a size of a few tens of nanometers has been used. However, since the planetary mixer stirs a large amount of the objects for a long time than the revolving and rotating stirrer, stirrability and workability significantly decrease. Furthermore, since the mixer is expensive, there is a problem that it is difficult to use the planetary mixer in a place where a small amount of the objects is stirred.

DISCLOSURE OF THE INVENTION

Technical Problem

To solve the above-described problem, an object of the present invention is to improve a structure of a container for a stirrer and thus to provide a container for a stirrer which rapidly crushes nanoparticle-sized objects without agglomeration and simultaneously disperses the objects.

Technical Solution

As a means for resolving the aforementioned technical problem, a container for a stirrer used in a stirrer stirring objects through a centrifugal force, includes: a container body of which the top is opened and in which a receiving space is formed; an outer lid coupled to the top of the container body; and a crushing unit including a supporting member disposed in the receiving space, and a crushing member extending outwardly from the supporting member and crushing and stirring the objects received in the receiving space.

An inner lid for sealing an inlet of the receiving space may be disposed between the container body and the outer lid, and the crushing unit may be disposed on the bottom surface of the inner lid.

The crushing unit may be non-rotatably fixed to the bottom surface of the inner lid.

The crushing member may include a top crushing piece which is installed in an upper portion of the supporting member, a bottom crushing piece which is installed in a lower portion of the supporting member, and a central crushing piece which is installed at the center of the supporting member.

The top crushing piece may be inclined upwardly and the bottom crushing piece may be inclined downwardly.

At least one of the top, bottom and central crushing pieces may be provided with two or more of crushing blades.

The crushing member may be provided on the supporting member in a circular form.

The crushing unit may be fixed by coupling of a bolt passing through the top surface of the inner lid, and a loosening preventing washer may be disposed between the bolt and the inner lid.

A reinforcing plate may be disposed on at least one of the top and bottom surfaces of the inner lid.

Advantageous Effects

According to the invention, a container for a stirrer is capable of rapidly crushing and simultaneously dispersing nanoparticle-sized objects without agglomeration. Therefore, it is possible to improve a mixing force and further to stir the nanoparticle-sized objects even by using the revolving and rotating stirrer.

BEST MODE FOR CARRYING OUT THE INVENTION

Figure 1:
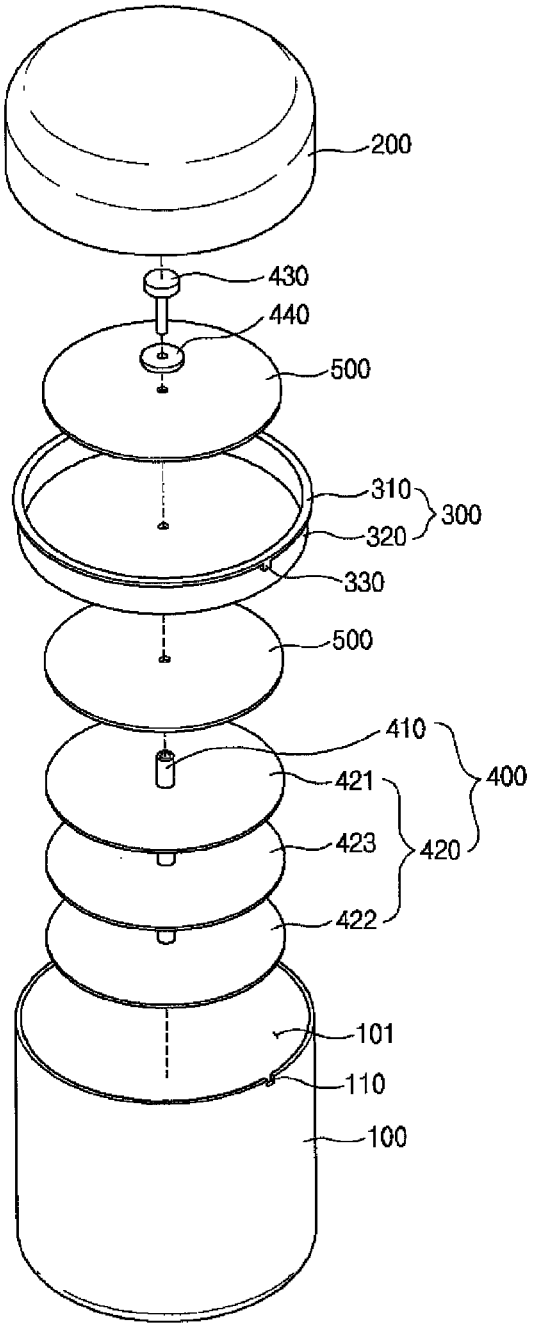
FIG. 1 is a perspective view illustrating a container for a stirrer according to the present invention.

A container for a revolving and rotating stirrer according to the present invention is provided with a crushing member inside thereof, and it is therefore possible to easily crush and disperse nanoparticle-sized objects without agglomeration and thus to stir the objects rapidly.

Hereinafter, an embodiment of the present invention will be fully described with reference to the accompanying drawings so that a person having an ordinary skilled in the art to which the present invention pertains could easily carry out. However, it should be understood that the present invention can be implemented in various modified forms and is not limited to the embodiments described herein. Further, it should be noted that for clarity of description, portions unrelated to the present invention are omitted in the drawings and like reference numerals are given to like elements throughout the specification.

Figure 2:
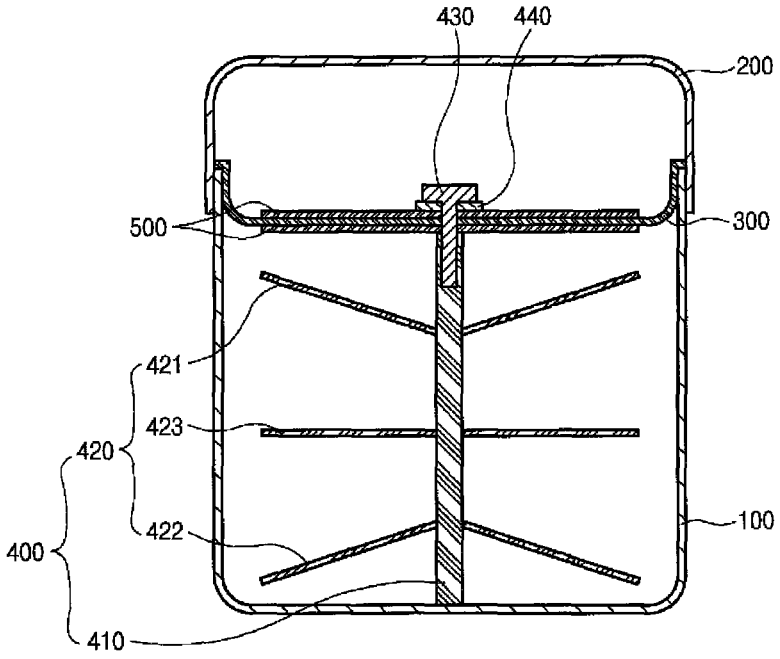
FIG. 2 is a sectional view illustrating the container for the stirrer according to the present invention.

As illustrated in FIGS. 1 and 2, a container for a stirrer according to an embodiment of the present invention is used in a stirrer (not shown) which stirs objects through a centrifugal force, and includes a container body 100, an outer lid 200 which is coupled to an opened top of the container body 100, an inner lid 300 which is provided between the container body 100 and the outer lid 200, a crushing unit 400 which is provided between the container body 100 and the outer lid 200 and crushes and disperses nanoparticle-sized objects (not shown) which are received in the container, and reinforcing plates 500 which are disposed on top and bottom surfaces of the inner lid 300, respectively.

The revolving and rotating stirrer which stirs the objects through the centrifugal force is a publicly known technique which has been widely used in an industry field. Therefore, a detailed description thereof will be omitted herein.

The container body 100 has a receiving space 101 which is opened upward, and may have a structure in any one of circular, triangular, tetragonal, elliptical, spherical and polygonal shapes using a resin material or stainless steel, and preferably have a circuit shape.

The outer lid 200 is coupled to the opened top of the container body 100 by screwing or fitting, and is made to have a structure which is symmetrical to the container body 100 using the same resin or stainless steel material as the container body 100.

One or more buckle device (not shown) may be disposed between the container body 100 and the outer lid 200 to increase a coupling force so that even during revolution and rotation, the container body 100 and the outer lid 200 are not separated from each other.

As an example, the buckle device includes a buckle having a ring which is rotatably disposed on the container body 100, and a locking hook which is disposed on the outer lid 200 and coupled to the ring for locking.

The inner lid 300 is to seal an inlet of a receiving space 101 and to fix the crushing unit, and is coupled to the opened top of the container body 100 between the container body 100 and the outer lid 200.

That is, the inner lid 300 includes a supporting surface 310 which is supported on a rim surface of the opened top of the container body 100, and a coupling surface 320 which extends downwardly from a bottom surface of the supporting surface 310 to be fitted into the opened top of the container body 100, wherein the crushing unit 400 is fixed to the center of a bottom surface of the coupling surface 320.

The inner lid 300 has a main function of fixing the crushing unit 400, and a function of preventing the crushing unit 400 from leaving from the container body 100, and a function of preventing vibration or noise generated from the crushing unit 400 from being transferred to the container body 100 or the outer lid.

Here, the inner lid 300 is made of the same resin or stainless steel material as the container body 100.

An insertion protrusion 330 and an insertion hole 110, which are coupled to each other, are formed on corresponding contact surfaces of the inner lid 300 and container body 100, and coupling of the inserting protrusion 330 to the insertion hole 110 prevents such a problem that, during revolution and rotation, the inner lid 300 rotates in a state where the inner lid 300 is coupled to the container body 100. This makes it possible to obtain a fixing force and a crushing force of the crushing unit 400 which is fixed to the inner lid 300.

The crushing unit 400 is used to simultaneously crush and disperse the nanoparticle-sized objects which are received in the container body 100, and includes a supporting member 410 which is disposed in a receiving space 101 of the container body 100 and a crushing member 420 which extends outwardly from the supporting member 410 to crush and disperse the objects (not shown) received in the receiving space 101.

The supporting member 410 is fixed by coupling a bolt 430 passing through the top surface of the inner lid 300 in a state where an upper portion of the supporting member 410 is supported on the center of the bottom surface of the inner lid 300, and a lower portion of the supporting member 410 extends to a position which is disposed apart from the bottom surface of the receiving space 101 of the container body 100 by a predetermined distance.

A loosening preventing washer 440 is disposed between the bolt 430 and the inner lid 300. By virtue of the release preventing washer 440, even when the container body 100 revolves and rotates, the bolt 430 is prevented from being loosened to thereby increase the fixing force of the supporting member 410.

The crushing member 420 is used to crush and disperse the objects received in the container body 100, and includes a top crushing piece 421 which is installed in an upper portion of the supporting member 410, a bottom crushing piece 422 which is installed in a lower portion of the supporting member 410, and a central crushing piece 423 which is installed at one side of the center of the supporting member 410.

That is, when the crushing member 420 revolves and rotates at the same time by the stirrer, the objects received in the container body 100 move in all directions. During movement of the objects, the objects collide with the top crushing piece 421, the bottom crushing piece 422 and the central crushing piece 423 to be crushed or dispersed, thereby resolving an agglomeration problem to result in an increase in a mixing force.

Meanwhile, the top crushing piece 421, the bottom crushing piece 422 and the central crushing piece 423 are provided in a circular form on the supporting member 410 (see FIG. 1), which makes it possible to minimize a dead zone in which the objects are not crushed and dispersed in the receiving space 101 of the container body 100 and thus to obtain a uniform crushing force and dispersion force over the entire receiving space 101.

The top crushing piece 421 is inclined upwardly and the bottom crushing piece 422 is inclined downwardly, thereby enabling even the objects moving from the top to the bottom or from the bottom to the top of the receiving space 101 of the container body 100 to be effectively crushed and dispersed.

The crushing unit 400 can effectively crush and stir the objects by using the supporting member 410 and the crushing member 420 even though the objects move to any positions in the receiving space 101, and consequently the mixing force can be enhanced.

Here, the crushing unit 400 is non-rotatably fixed to the inner lid 300 by coupling of the bolt 430. That is, if the crushing unit 400 is rotatably fixed to the inner lid 300, collision of the objects makes the crushing unit 400 rotate to cause the crush force to be weakened. Accordingly, by non-rotatably fixing the crushing unit 400 to the inner lid 300, the crushing force may be improved during collision of the objects.

In the embodiment of the present invention, description was given of a case where the supporting member 410 is non-rotatably fixed to the inner lid 300. However, if the structure of rotatably fixing the crushing unit 400 achieves a high level of crushing and stirring performances in the container to which the crushing unit 400 is applied, the supporting member may also be rotatably fixed to the inner lid 300.

Reinforcing plates 500 are disposed on the top and bottom surfaces of the inner lid 300 respectively to prevent deformation of the inner lid 300 caused by flow of the crushing unit 400 or collision of the objects. The reinforcing plates 500 are made of a metallic material having higher strength than the inner lid 300.

That is, the reinforcing plates 500 have a size sufficient to cover both the top and bottom surfaces of the inner lid 300, and are fixed to the top and bottom surfaces respectively by coupling the bolt 430 and the supporting member 410.

A use state of the container for the stirrer according to the embodiment of the present invention having the above-described configuration will be described below.

First, the container for the stirrer is prepared by separating, from the container body 100, the outer lid 200 and the inner lid 300 to which the crushing unit 400 is fixed, then inserting the nanoparticle-sized objects into the receiving space 101 of the container body 100, and again coupling the inner lid 300 and the outer lid 200 to the container body 100.

Thereafter, the container for the stirrer is mounted on the revolving and rotating stirrer and then revolved and rotated at the same time.

Then, the objects received in the container for the stirrer move in all directions in the container body 100. At this time, while colliding with the crushing member 420 of the crushing unit 400, that is, the top crushing piece 421, the bottom crushing piece 422 and the central crushing piece 423 the objects are crushed and dispersed without agglomeration, and thus the objects are mixed uniformly.

Moreover, since the crushing unit 400 is non-rotatably fixed to the bottom surface of the inner lid 300, vibrations and noises are not generated even when the container for the stirrer revolves and rotates. Therefore, crushing and stirring forces of the objects are increased.

Accordingly, the container for the stirrer of the present invention including the inner lid 300 and the crushing unit 400 enables the nanoparticle-sized objects to be mixed without agglomeration even using the revolving and rotating stirrer. Furthermore, even a small amount of the objects can be mixed, thereby improving workability.

Hereinafter, in the following description of another embodiment of the present invention, structures having the same configurations and features as those described in the previous embodiments will be illustrated by using the same reference numerals or symbols, and thus duplicated description thereof will be omitted herein.

Figure 3:
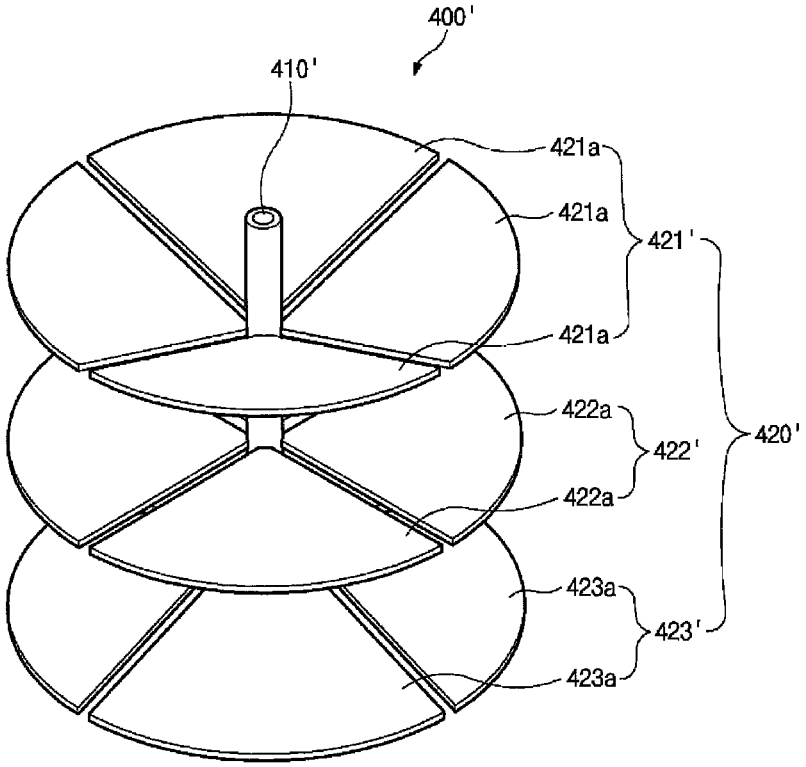
FIG. 3 is a perspective view illustrating another embodiment of a crushing member in the container for the stirrer according to the present invention.

FIG. 3 illustrates another embodiment of a crushing unit in the container for the stirrer of the present invention.

A crushing unit 400' according to the present embodiment is provided with a crushing member 420' on a supporting member 410'. The crushing member 420' includes a top crushing piece 421', a bottom crushing piece 422' and a central crushing piece 423'.

Here, each of the top crushing piece 421', the bottom crushing piece 422' and the central crushing piece 423' is provided with at least two crushing blades 421*a*, 422*a* and 423*a*. Thus, an area where the objects collide with the top crushing piece 421', the bottom crushing piece 422' and the central crushing piece 423' is increased, leading to further increase in the crushing force.

In addition, the two or more of the crushing blades 421*a*, 422*a* and 423*a* may be provided slantly as the configuration of an impeller or fan blade. This makes it possible to further increase the area where the objects collide with the top crushing piece 421', the bottom crushing piece 422' and the central crushing piece 423', leading to further increase in the crushing force.

Furthermore, as another embodiment of the present invention, the crushing member, although is not shown, may be provided with a plurality of vertical crushing blades on a main surface of the supporting member in a vertically up/down direction. The vertical crushing blades enable the objects received in the container body to be more effectively crushed and stirred.

The scope of the present invention is defined by the following claims rather than the detailed description, and it should be interpreted that the spirit and scope of the claims, and all variations and modified forms derived from equivalent concepts thereof are included in the scope of the present invention.

The invention claimed is:

1. A container for a stirrer that rotates and revolves the container to stir objects through a centrifugal force, the container being adapted to be mounted on the stirrer, the container comprising:

a container body having an open top defining an inlet to a receiving space formed therein, wherein the container body is configured to rotate and revolve during stirring of the objects;

an outer lid adapted to be coupled to the top of the container body such that the outer lid completely covers the inlet;

an inner lid for sealing the inlet, the inner lid being adapted to be coupled to the container body such that the inner lid is disposed between the container body and the outer lid; and a crushing unit including a supporting member positionable in the receiving space, the crushing unit including a crushing member extending outwardly from the supporting member for crushing and stirring the objects received in the receiving space, wherein the crushing unit is non-rotatably fixed to a bottom surface of the inner lid such that the crushing unit is positioned below the inner lid and is not rotatable with respect to the container body when the inner lid is coupled to the container body;

wherein the crushing member includes a top crushing piece installed in an upper portion of the supporting member, a bottom crushing piece installed in a lower portion of the supporting member, and a central crushing piece installed at a center of the supporting member; and wherein each of the top crushing piece, the bottom crushing piece, and the central crushing piece comprises an area that is segmented along at least one line so as to be subdivided into two or more crushing blades.

2. The container of claim 1, wherein the top crushing piece is inclined upwardly.

3. The container of claim 1, wherein the bottom crushing piece is inclined downwardly.

4. The container of claim 1, wherein the crushing member is provided on the supporting member in a circular form.

5. The container of claim 1, wherein the crushing unit is fixed by coupling it to a bolt passing through a top surface of the inner lid, and wherein a loosening preventing washer is disposed between the bolt and the inner lid.

6. The container of claim 1, wherein a reinforcing plate is disposed on at least one of a top surface and the bottom surface of the inner lid.

* * * * *